US005692053A

United States Patent [19]

Fuller et al.

[11] Patent Number: 5,692,053

[45] Date of Patent: Nov. 25, 1997

[54] ACTIVE ACOUSTIC TRANSMISSION LOSS BOX

[75] Inventors: Christopher R. Fuller, Blacksburg, Va.; Michael P. McLoughlin, Sykesville, Md.; Stephen Hildebrand, Arlington, Va.

[73] Assignee: Noise Cancellation Technologies, Inc., Linthicum, Md.

[21] Appl. No.: 411,779

[22] PCT Filed: Oct. 8, 1992

[86] PCT No.: PCT/US92/08401

§ 371 Date: Jul. 7, 1995

§ 102(e) Date: Jul. 7, 1995

[87] PCT Pub. No.: WO94/09484

PCT Pub. Date: Apr. 28, 1994

[51] Int. Cl.[6] ..... G10K 11/16

[52] U.S. Cl. ..... 381/71

[58] Field of Search ..... 381/71, 94; 415/119

[56] References Cited

U.S. PATENT DOCUMENTS

| | | | |
|---|---|---|---|
| 2,776,020 | 1/1957 | Conover . | |
| 3,602,331 | 8/1971 | Bschorr . | |
| 4,025,724 | 5/1977 | Davidson, Jr. et al. . | |
| 4,689,821 | 8/1987 | Salikuddin et al. | 381/71 |
| 4,715,559 | 12/1987 | Fuller | 381/71 |
| 4,815,139 | 3/1989 | Eriksson et al. | 381/71 |
| 4,947,434 | 8/1990 | Ito | 381/71 |
| 5,091,953 | 2/1992 | Tretter . | |
| 5,315,661 | 5/1994 | Gossman et al. | 381/71 |
| 5,347,586 | 9/1994 | Hill et al. | 381/71 |
| 5,370,340 | 12/1994 | Pla | 381/71 |

*Primary Examiner*—Forester W. Isen

[57] ABSTRACT

The invention relates to noise or sound control achieved by enclosing the noise source in an active enclosure. Arrays of vibration inputs (for example, shakers, piezoceramics, etc.) are attached to the walls of the active enclosure, or loudspeakers located inside the enclosure can be used to excite the sides of the enclosure. An array of error microphones are located in the radiated acoustic field or PVDF strips are positioned on the wall. A controller senses the levels of sound observed at the error microphones or PVDF film and adjusts the oscillating inputs (in terms of frequency content, phase and magnitude) to the active vibration inputs in order to minimize the radiated sound.

17 Claims, 7 Drawing Sheets

ACTIVE ACOUSTIC TRANSMISSION LOSS BOX

BACKGROUND OF THE INVENTION

This present invention relates generally to noise or sound control and more particularly to the control of radiated sound from vibrating machinery by enclosing the machinery in what is termed an "active box or container". The purpose of the active box is to markedly reduce the radiation of the sound from the machine to observation points in the surrounding field, with a very lightweight, compact, non-airtight structure.

DISCUSSION OF RELATED ART

In many applications the radiation of sound from vibrating machines is an annoying noise problem. One technique which has been used in the past is to enclose the machine in a high transmission loss (TL) box in order to reduce the radiated sound (as described, for example, in U.S. Pat. No. 4,715,559, hereby incorporated by reference, herein and in "Noise and Vibration Control" by L. Beranek, 1988). These conventional boxes attenuate the sound transmitted through their walls by passive means. In order that the container be effective, i.e. strongly reduce the sound, it has to be both airtight and constructed from material which has a high density and thickness. These two conditions have a number of practical disadvantages. For example, the airtight condition implies that it would be extremely difficult to build an effective high TL container for applications which require air flow (e.g.a.c. units, compressors, etc.) or piping and wiring connections or ventilation for cooling. These requirements would imply significant holes through which the acoustic energy could leak. The high density material condition of course would imply that the box be extremely heavy and large in size, a problem which is exacerbated as the frequency of sound becomes lower.

Previous work has shown the extremely high potential of using active vibration inputs to structures to reduce the radiated sound from the structural vibration. Such work is described in "Apparatus and Method for Global Noise Control", U.S. Pat. No. 4,715,559, 1987, by C. R. Fuller and "Control of Sound Radiation with Adaptive Structures", Journal of Intelligent Material Systems and Structures, Vol. 2, pp. 431–452, 1991, by R. L. Clark and C. R. Fuller. The control inputs can be in the form of point force shakers or surface strain devices, such as piezoelectric elements, bonded to the surface of the structure. In order that the control approach be efficient and effective, the variable to be minimized has to be the radiated sound from the panel, measured, for example, by error microphones located in the radiated sound field as in Fuller. The controller format can be any control approach which adjusts the oscillating voltage inputs to the piezoelectric inputs, for example, in order to minimize the radiated sound observed at the error microphones. Polyvinylidene fluoride (PVDF) piezoelectric distributed sensors on the surface of a panel have been used in place of microphones to sense modes of the panel which are radiating efficiently to the far field such as that described in "Modal sensing of efficient acoustic radiators with polyvinylidene fluoride distributed sensors in active structural acoustic control approaches", J. Acoustical Society of America, pp. 3321–3329, June 1992, by Clark and Fuller. The work of Clark and Fuller, for example, demonstrates attenuations of the order of 20 dB of sound radiated from panels in the low frequencies (f<600 Hz) with only one or two active actuator inputs.

OBJECTS OF THE INVENTION

It is accordingly an object of the present invention to achieve high attenuation of radiated sound from a vibrating machine by enclosing it with an "active acoustic transmission loss box".

It is another object of the invention to achieve very high global (here global means throughout an extended area of "volume"), of sound with the above box constructed from very lightweight thin material, or to use the sides of the sound source itself to reduce radiated noise.

It is another object of the invention to achieve very high global sound attenuation with a container that is not airtight, rather it has significant air gaps or holes located in the walls of the container.

These and other objects will become apparent when reference is had to the accompanying drawings in which FIG. 1 is a schematic of a typical box (in this case rectangular) surrounding a noisy machine. The active inputs, error microphones and PVDF film as discussed above are shown. Also demonstrated is an air gap in the box sidewall.

SUMMARY OF THE INVENTION

The machine to be quieted is surrounded by an active enclosure. Arrays of vibration inputs (for example, shakers, piezoceramics, etc.) are attached to the walls of the active enclosure, or loudspeakers located inside the enclosure can be used to excite the sides of the enclosure. An array of error microphones are located in the radiated acoustic field or PVDF strips are positioned on the wall. A controller senses the levels of sound observed at the error microphones or PVDF film and adjusts the oscillating inputs (in terms of frequency content, phase and magnitude) to the active vibration inputs in order to minimize the radiated sound. On minimizing the sound at the error microphones or PVDF film the radiated sound from the machine is globally attenuated. Note that the container can be of any shape and material, and can have significant air gaps through the walls.

DESCRIPTION OF PREFERRED EMBODIMENTS

Figure 1:
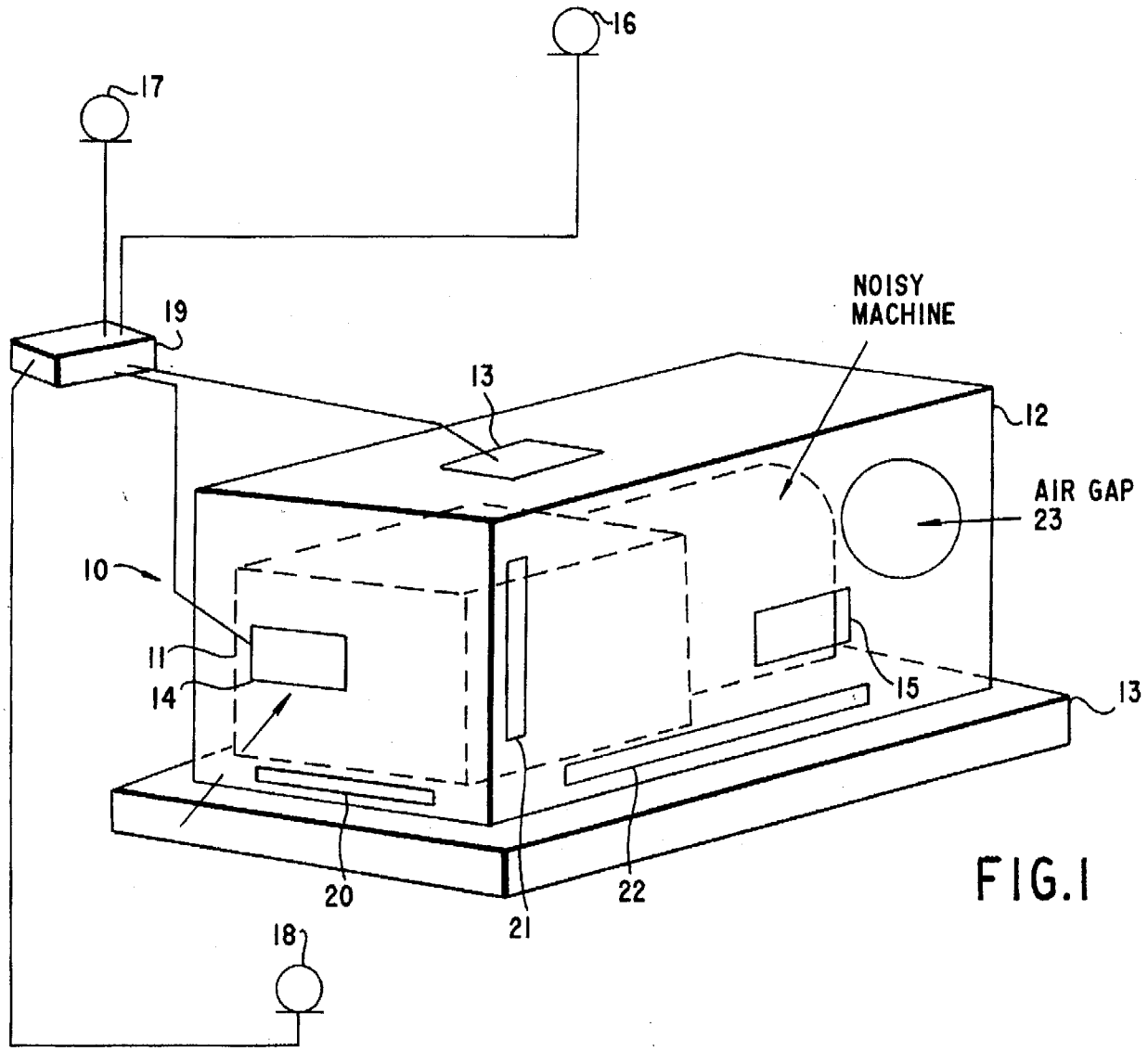

Referring now to the drawings, an example configuration of the "Active Acoustic Transmission Loss Box" is shown in FIG. 1 as 10. A machine 11 is operating and radiating unwanted noise inside the box. The machine requires some air flow for cooling etc. as well as piping and electrical connections and an air gap 23 can be provided. In order to control the sound radiation the machine is surrounded by an enclosure, in this case a rectangular box 12. In the example of FIG. 1, the box 12 is resting on the machine support base 13 but also could totally surround it. Damping or absorptive materials can also be added to the box to attenuate high frequency noise and improve the structural response of the enclosure. The box can be constructed from a variety of materials such as thin steel, aluminum, etc. In the case shown the box is manufactured from 6.35 mm plexiglass and has dimensions 304.8×304.8×406.4 mm. Piezoceramic control actuators such as 13, 14, 15 (type G1195 of thickness 0.19 mm and dimensions 38.1×63.5 mm) are bonded to the center of each panel. Each actuator consists of a piezoceramic element bonded onto each side, co-located and wired in parallel with 180° phase shift. Such a configuration produces high vibration of the panels. These elements can be positioned in various arrays and also embedded in the material if required.

In order to sense the radiated noise field, a number of error microphones such as 16, 17, 18 are positioned in the radiated noise field. The number and location of the error microphones is dependent upon the modal contribution (from the panel vibration) and radiation directivity of the noise. Hydrophones may be used in place of error microphones 16, 17, 18. A controller 19 is employed which measures the output of the error microphones and then constructs an oscillating control signal of the correct frequency content and phase which, when fed to the control actuators 13, 14, 15, etc. causes the sound to be markedly reduced at the error microphones and other locations. An alternative to microphones is PVDF thin film which can be placed on the walls in such a way that energy in the radiating modes is sensed. One possible configuration for the PVDF strips such as 20, 21, 22 is shown in FIG. 1. Another alternative would be to use accelerometers to sense the motion of specific points on the enclosure walls.

Figure 2:
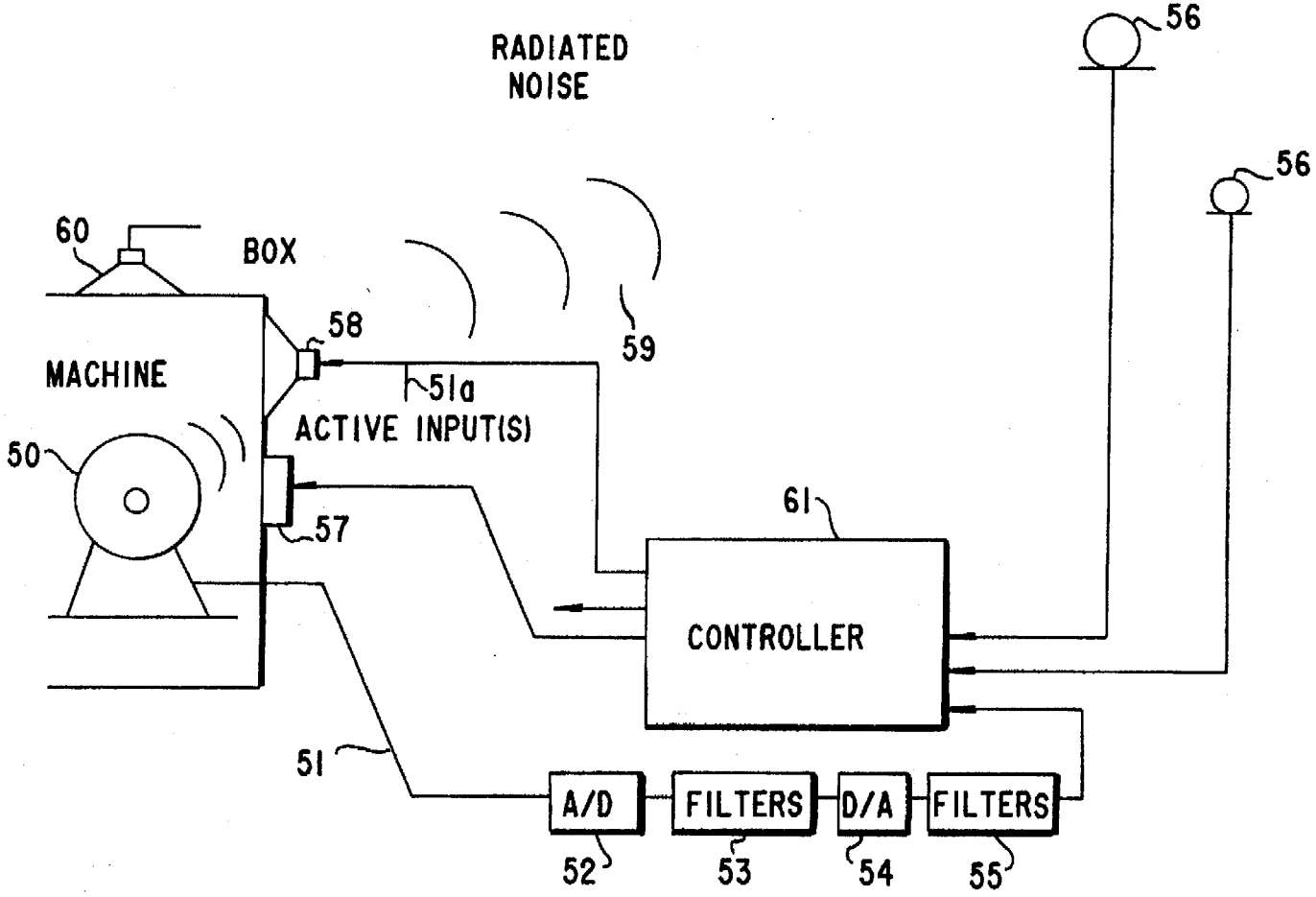
FIG. 2 is a typical general controller arrangement used to derive the correct active control signal, using microphones as error sensors.

One particular control arrangement embodies the Filtered-X adaptive LMS algorithm discussed by Fuller and is illustrated in FIG. 2. An oscillating reference signal which has the frequency content of the noise to be canceled is taken from machine 50. This reference signal 51 is also highly coherent with the output of the error microphones. The reference signal is passed through an analog to digital (A/D) converter 52 and fed through a number of adaptive filters 53. The number of adaptive filters is equal to the number of control actuators used. The arrangement of the adaptive filter is dependent upon the frequency content of the noise. The outputs of the adaptive filters is then passed through D/A converters 54 and smoothing filters 55. For piezoceramic actuators 57, this control signal is typically passed through a high voltage power amplifier and then connected to the electrodes of each actuator. The error signals from the microphones 56 are sampled using A/D converters and then used in conjunction with the reference signal and a filtered-X update equation in the controller 61 in order to adapt or change the coefficients of the adaptive filters so as to minimize the error signals from the microphones as far as possible.

In an experimental arrangement to test the performance of such a system the noisy machine is replaced with a 165.1 mm speaker 58 positioned in a 184.2 m×184.2 m×114.3 m reflex box. Various test frequencies are then fed to the speaker to generate noise. The reference signal 51*a* in this case is taken directly from the signal 59 driving the speaker. For this test the control actuators on diametrically opposite panels were wired in phase, creating in conjunction with a top actuator 60, three independent control channels and hence three adaptive filters. Three error microphones such as 56 were positioned at a distance of approximately 2 m from the box. In this arrangement the air gap 23 shown in FIG. 1 is approximated by raising the box using 25.4 mm blocks at each corner thus leaving a total air gap of 361.2 $cm^2$, giving a percentage open area in the box of 6.5%.

Figure 5:
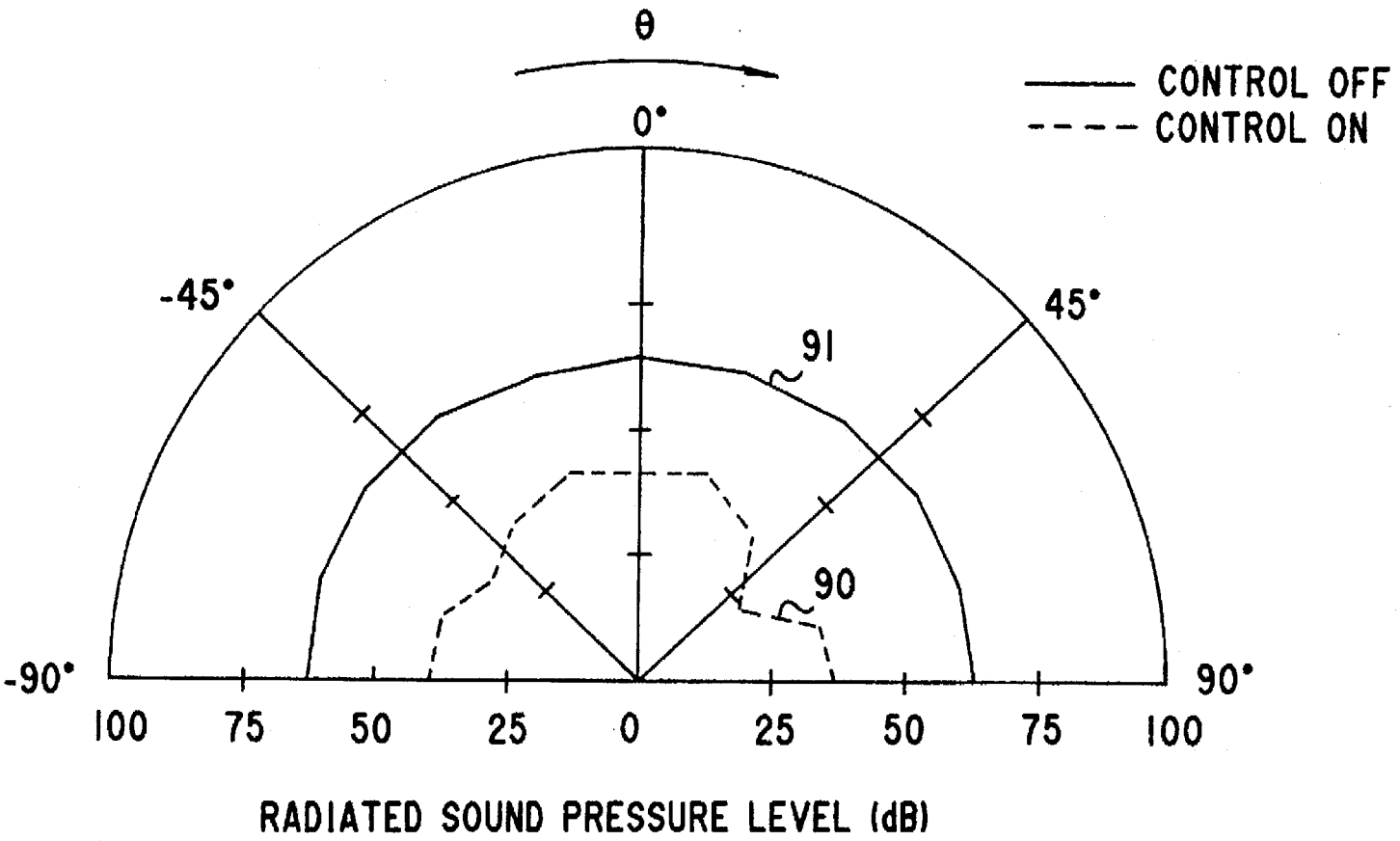
FIG. 5 is an azimuth plot of typical noise radiation from an enclosure with and without active control.
Figure 6A:
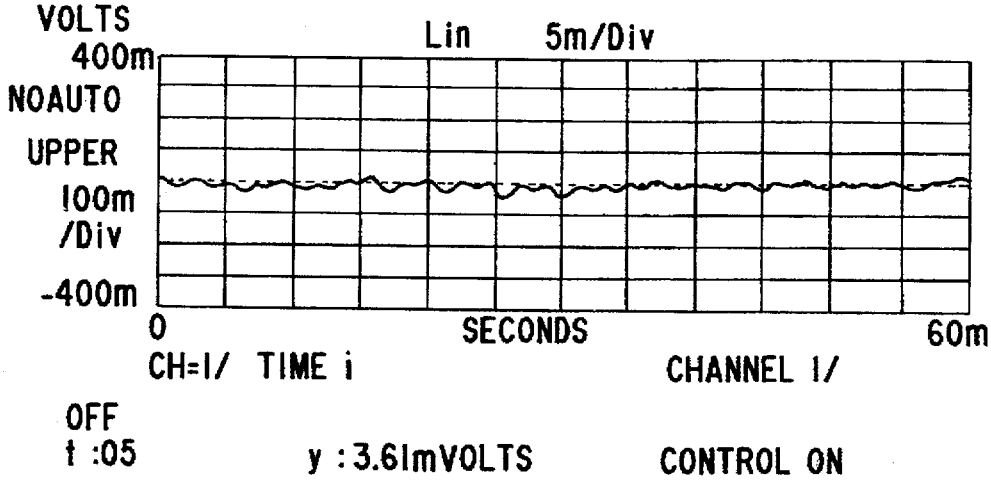
FIG. 6 shows a typical noise spectrum at a selected error microphone with and without control. This result shows control of broadband or multiple frequencies simultaneously.
Figure 6B:
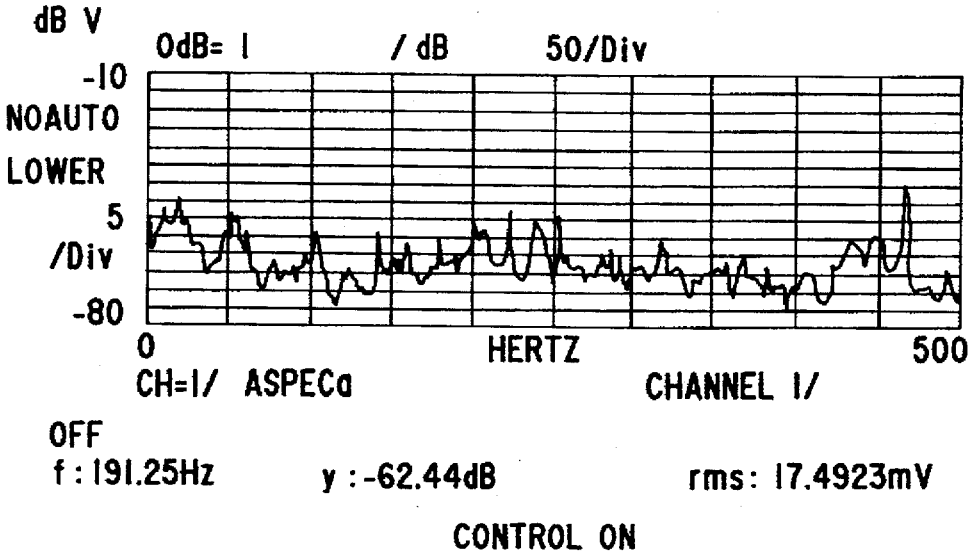
Figure 6C:
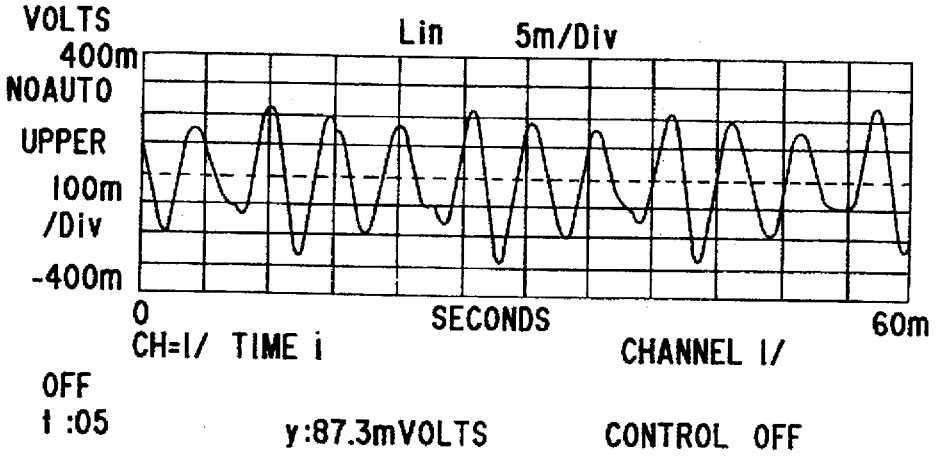
Figure 6D:
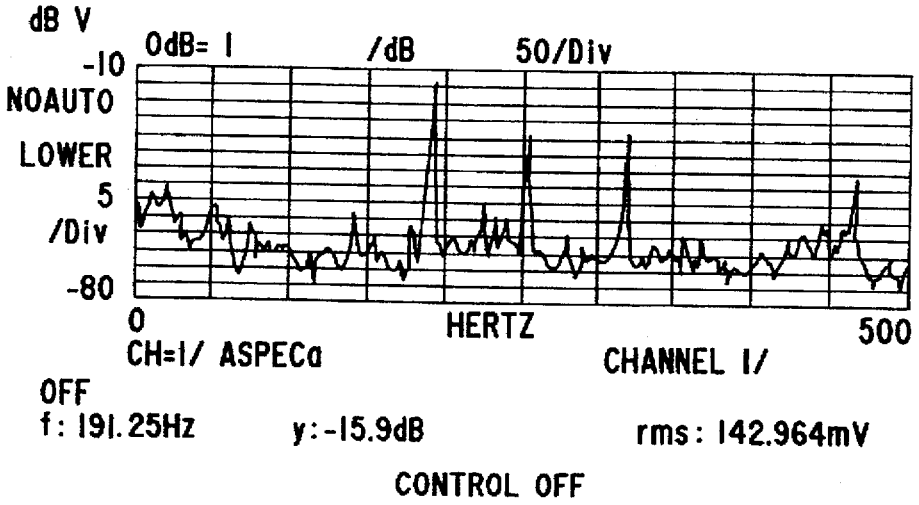

FIG. 5 shows a typical radiation directivity pattern measured around the box at mid plane and a distance of 1.7 m. The curve 90 labeled "control on" gives the radiated noise field with control. The curve 91 "control off" gives the radiated noise field when the control is not activated. It is apparent that the provides a large attenuation of the sound. When the control is turned on, the results of FIG. 5 and 6, labeled "control on " show high sound reductions of the order of 20 dB at all angles (i.e. global control).

As discussed by Fuller in U.S. Pat. No. 4,715,559 the active attenuation is achieved as follows. The noise source inside the box radiates sound which strikes the enclosure walls and causes it to vibrate (at the same frequency content as the noise source). The vibrating walls then radiate sound away to the exterior free field of the box where it appears as unwanted noise. The active inputs work as follows. The structural actuators cause anti-vibration in the walls of the enclosure. When the inputs to the structural actuators are adjusted correctly these anti-vibrations cancel out those vibrations in the box which were previously radiating sound, thus leading to global sound reduction. As in Fuller's patent, not all vibrations (or modes) in the enclosure will radiate sound and thus the active inputs need only cancel those vibrations (or modes) that are efficient radiators rather than controlling all the vibration. This approach leads to a very low number of control actuators as opposed to totally canceling the box vibration, and is the key to the success of the approach.

Figure 4:
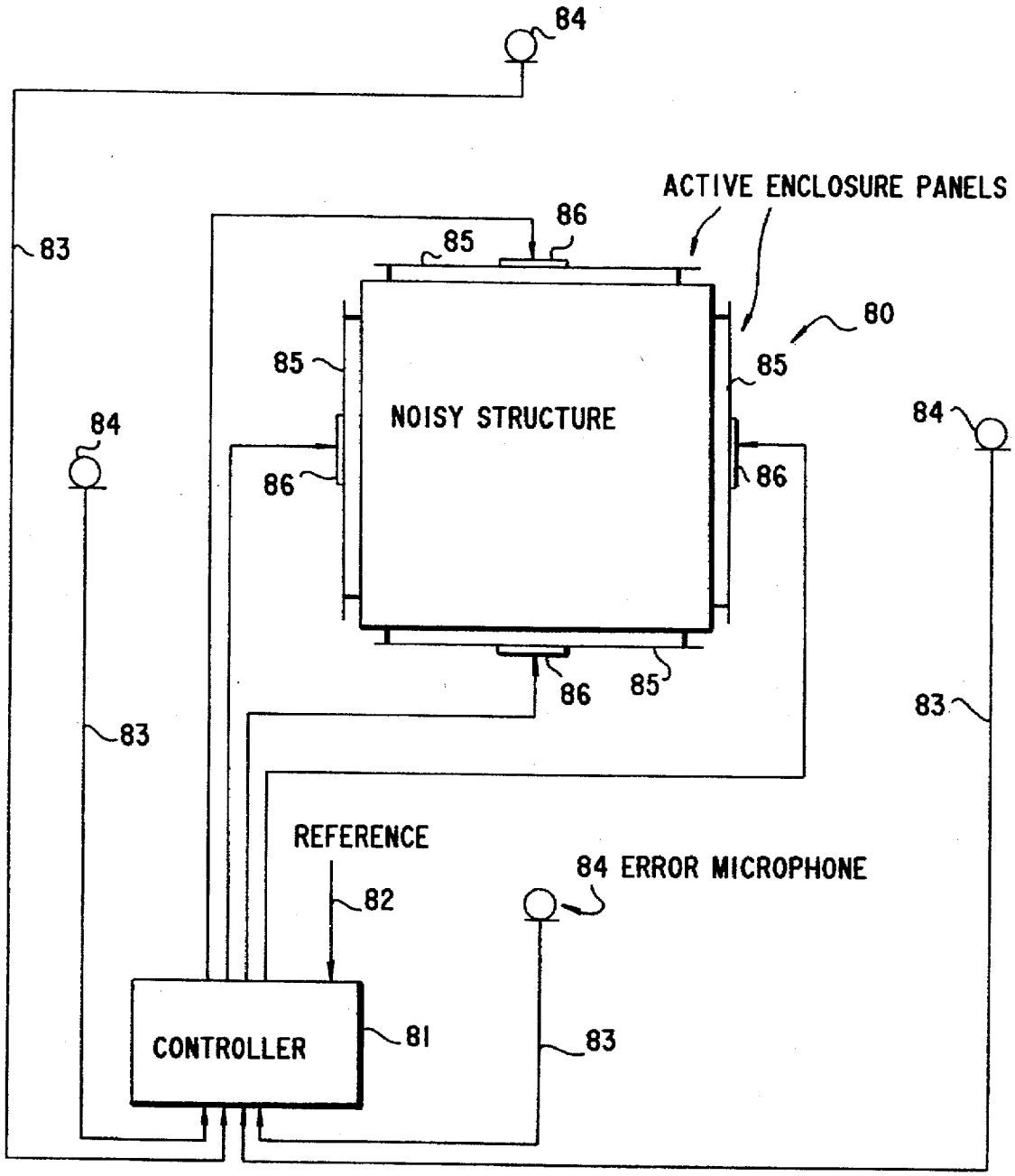
FIG. 4 is a schematic of the use of panels to surround a noisy structure.

An alternative, shown in FIG. 4, is to enclose the noisy structure 80 with close fitting panels 85 instead of a free standing enclosure. In this case the enclosure panels are attached directly to the sides of the noise source. If the regions generating noise are localized or if noise control is needed in certain directions, an advantage to this method is that the need to enclose the entire structure is eliminated. In addition, in many cases a more compact enclosure can be constructed without restricting airflow needed for cooling. An example of an application of this method would be for the reduction of "hum" from electrical transformers. Transformer noise is generated from magnetostrictive forces in the coil and are propagated to the transformer skin through the oil field and coil foundation.

FIG. 4 shows a cancellation system 80 for enclosing a noisy structure with close fitting panels. Controller 81 receives a reference signal 82 from the structure and inputs 83, from error microphone 84. Actuators 86 are located on close fitting panels 85.

Figure 3:
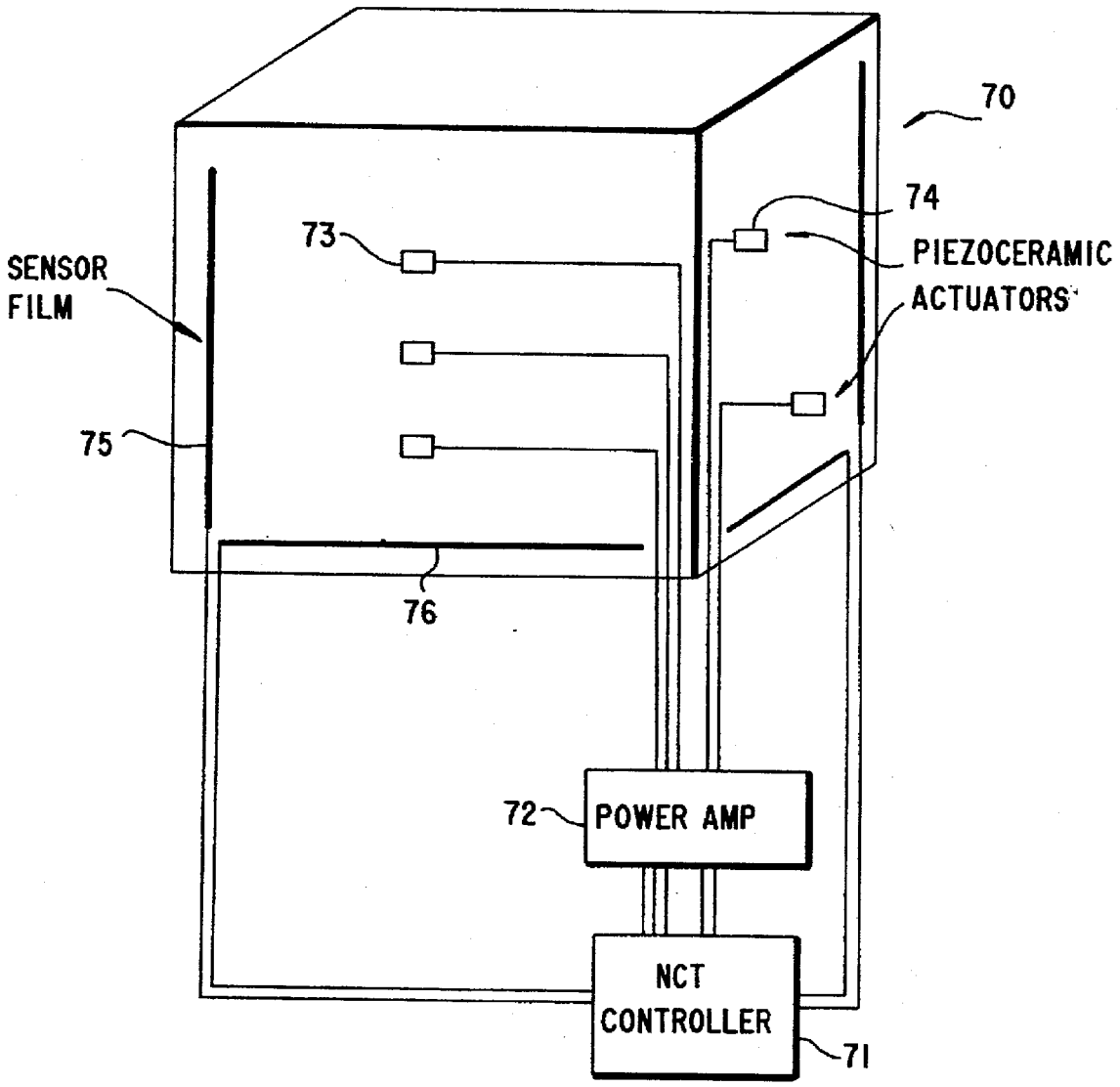
FIG. 3 is a typical general controller arrangement used to derive the correct active control signal using PVDF film as an error sensor.

Still another alternative shown in FIG. 3 is to place the actuator directly on the surface of the noise source.

FIG. 3 shows noise reduction system 70 with active structural control provided with a Noise Cancellation Technologies, Inc. controller 71 and power amplifier 72 having outputs to piezoceramic actuators such as 73, 74 and inputs from PVDF sensor film strips such as 75, 76, 77.

An alternative to using structural actuators to anti-vibrate the enclosure walls is to use loudspeakers to generate a pressure field inside the box that will produce the anti-vibrations. Combinations of different sensors such as speakers and microphones can also be used.

Having described the invention in detail it will be obvious to those of ordinary skill in the art that changes can be made without departing from the scope of the appended claims in which

We claim:

1. An active noise reduction system for canceling a noise disturbance, said system comprising a structural container means surrounding a noise disturbance with actuator means directly attached thereto to generate anti-vibrations into said structural container means, and a plurality of error sensing means in the radiated noise field sensing noise radiation external to said structural container means and providing error signals, and a reference signal generator means for prodding a reference signal containing frequency and temporal information on the noise disturbance, and a controller means composing circuit means for independently controlling each actuator in response to said error sensing means and said reference signal to drive said error signals to minimum values simultaneously.

2. The system of claim 1 wherein said actuator means are embedded piezoceramic actuators.

3. The system of claim 1 wherein said actuator means are electrodynamic shakers.

4. The system of claim 1 wherein said actuator means are surface mounted piezoceramic actuators.

5. The system of claim 1 wherein said actuator means are loudspeaker means.

6. The system of claim 1 wherein said error sensing means are PVDF film.

7. The system of claim 1 wherein said error sensing means are microphones.

8. The system of claim 1 wherein said error sensing means are hydrophones.

9. The system of claim 1 wherein said structural container means has an air gap therein.

10. The system of claim 9 wherein said actuator means are piezoceramic actuator means.

11. The system of claim 9 wherein said actuator means are loudspeaker means.

12. The system of claim 9 wherein said error sensing means are PVDF film.

13. The system of claim 1 wherein said container means has wall means adapted to be close fitting to said noise disturbance.

14. The system of claim 13 wherein said actuator means comprise piezoceramic actuator means.

15. The system of claim 13 wherein said error sensing means comprises PVDF film.

16. A method for controlling sound radiation of a noise disturbance by active control of a structural transmission loss container, comprising the steps of:

(1) surrounding said noise disturbance with a structural transmission loss container;

(2) sensing a respective error signal indicative of the noise field external to said structural transmission loss container sound radiation;

(3) generating a reference signal containing frequency and temporal content of the noise disturbance;

(4) actively vibrating the structural transmission loss container with active inputs in the form of vibration inputs directly attached or injected into said structural transmission loss container via active actuators;

(5) controlling the sound radiation at the error signals by adjusting oscillating inputs to the active actuators by a suitable control law.

17. The system of claim 1 wherein the actuator means generate anti-vibrations only for vibrations of the structural container that are efficient radiators.

* * * * *